United States Patent [19]

Chaix et al.

[11] Patent Number: 4,721,067

[45] Date of Patent: Jan. 26, 1988

[54] DEVICE FOR INJECTING A LIQUID INTO A TUBE AND STEAM GENERATOR COMPRISING THIS DEVICE

[75] Inventors: Jean-Edmond Chaix, Pierrevert; Michel Metteey, Equilles; Jean-Paul Badoux, Le Puy Sainte Reparade, all of France

[73] Assignee: Commissariat a l'Energie Atomique, Paris, France

[21] Appl. No.: 739,009

[22] Filed: May 29, 1985

[30] Foreign Application Priority Data

May 29, 1984 [FR] France ..... 84 08414

[51] Int. Cl.[4] ..... F22B 1/06

[52] U.S. Cl. ..... 122/32; 122/34; 122/483; 165/162; 165/134.1

[58] Field of Search ..... 122/32, 33, 483, 488, 122/508, 511; 165/134.1, 162

[56] References Cited

U.S. PATENT DOCUMENTS

| | | | |
|---|---|---|---|
| 3,357,409 | 12/1967 | Williamson et al. | 122/32 |
| 3,596,638 | 8/1971 | Michel | 122/32 |
| 3,707,186 | 12/1972 | Zorrilla et al. | 165/134.1 |
| 3,992,172 | 11/1976 | Clark | 122/34 |
| 4,191,246 | 3/1980 | Cassell | 165/134 |
| 4,285,396 | 8/1981 | Schwoerer et al. | 165/162 |
| 4,411,308 | 10/1983 | Koerdt et al. | 165/134.1 |
| 4,579,087 | 4/1986 | Stol et al. | 122/32 |

FOREIGN PATENT DOCUMENTS

| | | |
|---|---|---|
| 554160 | 6/1932 | Fed. Rep. of Germany . |
| 2927977 | 1/1981 | Fed. Rep. of Germany . |
| 1439413 | 6/1976 | United Kingdom . |

*Primary Examiner*—Henry C. Yuen

[57] ABSTRACT

Device for injecting a liquid into a tube and steam generator incorporating this device.

The cannula has a divergent portion, means located on the bottom part of the cannula for centering the same and immobilizing it in translation relative to the tube, together with a sleeve surrounding the cannula. The means for centering and immobilizing the cannula in translation on the tube are constituted by a centering part, at least one slot and an inner cone formed in the sleeve, an outer cone formed on the bottom part of the cannula, said cones cooperating with one another, means being provided for elastically applying the outer cone to the inner cone.

2 Claims, 2 Drawing Figures

DEVICE FOR INJECTING A LIQUID INTO A TUBE AND STEAM GENERATOR COMPRISING THIS DEVICE

BACKGROUND OF THE INVENTION

The present invention relates to a device for injecting a liquid into a tube having a so-called cannula arranged in said tube whereby, in the fluid injection direction, the cannula has a narrowed section passage, followed by a divergent portion. It is more particularly used for injecting water into a steam generator or boiler and particularly of the vertical penetration single-pass type.

Single-pass, helical steam generators have a pressure resistant envelope containing wound tubes. A first heat transfer fluid, called the primary fluid circulates outside said tube. A secondary fluid passes through the network of tubes and enters through the envelope cover into the tubes via thermal sleeves traversing a tube plate. It then descends via bundles of straight tubes positioned in the central area of the steam generator until reaching the bottom of wound tubes via which it rises and then passes out in vapour form through sleeves traversing the cover periphery.

In such a steam generator, the secondary fluid flow can lead to instability, which particularly occurs under low power operating conditions and which is highly prejudicial to the operation of the apparatus.

SUMMARY OF THE INVENTION

The present invention relates to a device for injecting a liquid into a tube and which obviates these disadvantages. This device is characterized in that it comprises a cannula arranged in said tube whereby, in the flow injection direction, the cannula has a reduced section passage, followed by a divergent portion. Tests have shown that the use of such an injection device makes it possible to eliminate the aforementioned instability. Preferably, the passage cross-section of the fluid in the cannula is defined in such a way that the velocity of said fluid exceeds 0.7 m/s.

In addition, the invention relates to a steam generator having an envelope, a tube plate located within the envelope and subdividing the latter into a water box and a heat exchange zone, an inlet and an outlet for a primary fluid located in the heat exchange zone of the envelope, an inlet and an outlet for a secondary fluid in the water box, a plurality of tubes having an inlet end and an outlet end for the secondary fluid, said inlet and outlet ends being fixed to the tube plate, each tube having a linear portion on the side of its inlet end, as well as a device for injecting secondary fluid into a tube having a cannula disposed within the inlet end of a tube and having a passage cross-section for the secondary fluid. The passage cross-section of the cannula is followed, in the secondary fluid circulation direction, by a divergent portion, a sleeve being positioned between the cannula and the linear portion of the tube. Means are provided for centering the cannula relative to said linear portion of the tube.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
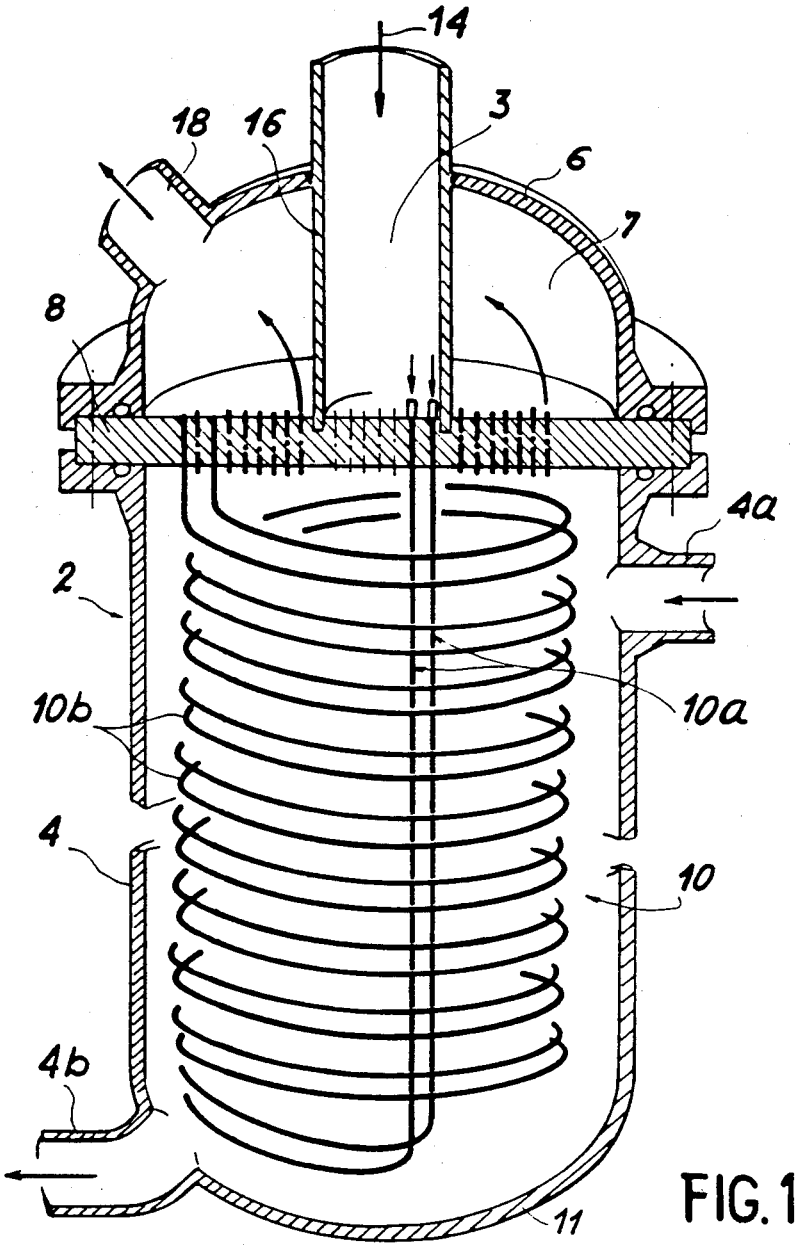
FIG. 1 a sectional perspective view of a single pass steam generator, in which an injection device according to the invention is installed.

FIG. 1 is a sectional and perspective view of a vertical penetration, single-pass steam generator equipped with an injection device according to the invention. This generator, designated by the general reference 2, has a pressure-resistant envelope 4, which is vertically axed and has a generally elongated cylindrical shape. Envelope 4 has a convex bottom 11. It is closed in its upper part by a cover 6. Between the cover and the envelope is provided a thick plate 8, called the tube plate. The cover 6 has a convex shape and defines a volume 7, called the water box. The water box 7 is subdivided into two zones by ferrule 16, a circular central zone for the entry of the water and an annular zone for the discharge of the vapour. The latter is discharged by a duct 18. Within the envelope 2 is provided a tube system or network 10. Each tube has a straight, vertically positioned portion **10*a* fixed to the tube plate. The straight portion 10*a* is terminated by a bend, which connects it to a spiral portion 10*b* connected to the peripheral zone of tube plate 8. An inlet 4*a* and an outlet 4*b* are provided in envelope 4 to permit the circulation of a primary fluid. A secondary fluid circulates within the tube network 10. The secondary fluid, e.g. water, penetrates in the direction indicated by arrow 14 into the water box 7 and then into the straight portion 10*a* of tubes 10**.

In a steam generator of this type, the secondary fluid flow can be the source of instability under low power operating conditions. The Applicant has found that during its drop into the straight tubes, the water is heated and has time to reach its saturation temperature. Thus, vapour bubbles form and they tend to rise, but the current is too weak to entrain them. Thus, these bubbles are accumulated at the entrance to the steam generator in the central zone of the water box 7 and form a vapour cushion there, which suddenly condenses on contact with the cold water entering the steam generator. This sudden condensation leads to a vacuum, which causes a reversal of the flow by sucking upwards the water which has just been injected. This transient phenomenon is followed by a return to normal conditions and the sequence recommences periodically.

The invention relates to a device for injecting a fluid into a pipe and which eliminates this phenomenon. This result is obtained by increasing the injection speed, in such a way that the water does not have time to reach its saturation temperature during its passage in the straight tubes **10*a*. Tests have shown that for a steam generator, like that shown in FIG. 1**, the injection rate must be greater than 0.7 m/s.

Figure 2:
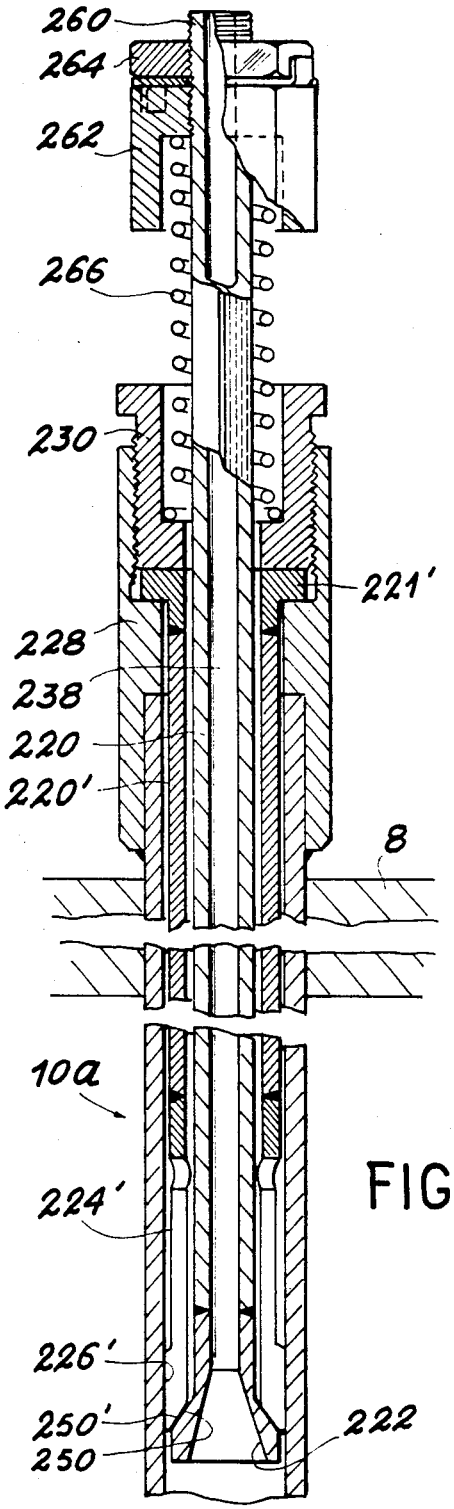
FIG. 2 a sectional view of an embodiment of the invention.

FIG. 2 shows a sectional view of a preferred embodiment of an injection device according to the invention. Reference numeral 8 designates the tube plate and reference numeral **10*a* a tube fixed in said tube plate. Tube 10*a* is surmounted by a top part 228**, which is fixed to the tube by forcing on or by welding.

The injection device has a so-called cannula 220, constituted by a tube having a central duct 238 with a reduced cross-section and whose diameter has been defined in such a way that the speed of the secondary fluid always exceeds 0.7 m/sec.

Knowing the characteristics of the steam generator and in particular the secondary water flow rate, it is easy for the expert to define said cross-section because the product of the flow rate by the passage section is constant.

At its lower end, cannula 220 has a divergent portion 222 making it possible to increase the passage cross-section available to the fluid and consequently reduce its speed to a low value, so that there is no erosion in the bend of the tube located immediately downstream of the cannula. The part fixed by welding and in which the divergent portion 222 is formed is externally provided with a conical portion 250 for the centering and fixing of the cannula with respect to tube 10*a*. In its upper part, the cannula has a threaded portion 260.

A collet 262 is screwed onto the threaded portion 260. The collet 262 is immobilized by a lock nut 264, which is arrested in rotation in per se known manner.

Cannula 220 is surrounded by a sleeve 220', which has an outer shoulder 221'. In the represented embodiment, the part on which the shoulder 221' is formed is joined by welding to the main part of the sleeve.

In its lower portion, the sleeve has a cylindrical centering part 226', whose external diameter is close to the internal diameter of tube 10*a*. The sleeve also has a female cone 250', which cooperates with the male cone 250 of the cannula. Longitudinal slots 224' are provided, in order to give elasticity and permit the expansion of conical part 250'.

The top part 228 has an inner shoulder for supporting the sleeve shoulder 221'. A plug 230 is screwed into an internal threaded portion of the top part. This plug secures shoulder 221' on the head part. Internally, the plug has a recess for a helical spring 266, which surrounds the cannula 220 and is positioned between plug 230 and collet 262. The function of spring 266 is to ensure the locking and expansion of the conical portion 250' of the sleeve.

This embodiment has the advantage of making it possible to make up the differential expansions between the cannula and the sleeve at the time of injecting cold water. Moreover, the relative displacement of the cannula and the sleeve takes place freely at the top part and not under frictional stress in tube 10*a*.

What is claimed is:

1. A steam generator having an envelope, a tube place located within the envelope and subdividing the latter into a water box and a heat exchange zone, an inlet and an outlet for a primary fluid located in the heat exchange zone of the envelope, an inlet and an outlet for a secondary fluid in the water box, a ferrule dividing the water box into a central inlet zone and a peripheral steam outlet zone located externally of said central inlet zone, a plurality of tubes having an inlet end and an outlet end for the secondary fluid, said inlet ends of the tubes being fixed to the tube plate in the inlet zone of the water box, and said outlet ends of the tubes being fixed to the tube plate in the outlet zone of the water box, each tube having: a linear portion at the inlet end, a helical portion surrounding said linear portion, as well as a device for injecting secondary fluid into the tube, said device having a cannula disposed within the inlet end of the tube and having a passage cross-section for the secondary fluid, followed, in the secondary fluid circulation direction, by a divergent portion, a sleeve being positioned between said cannula and the linear portion of the tube, means for centering the cannula relative to the linear portion of the tube, said means comprising at least one slot, an internal cone formed in the sleeve, an external cone formed on a bottom part of the cannula, said cones cooperating with one another, and means for elastically applying the outer cone to the inner cone, said means for applying the outer cone to the inner cone being constituted by locking means located at the upper end of the cannula and by a spring interposed between said locking means and a plug screwed onto a top part of the tube, the passage cross-section of the fluid in the cannula being such that the speed of said fluid exceeds 0.7 m/s.

2. A device according to claim 1, wherein the locking means are constituted by a collet screwed onto a threaded portion of the cannula and by a lock nut.

* * * * *